United States Patent [19]

Watanabe

[11] 4,080,054

[45] Mar. 21, 1978

[54] DEVICE FOR REPLENISHING TONER PARTICLES

[75] Inventor: Toshio Watanabe, Ebina, Japan

[73] Assignee: Rank Xerox Ltd., London, England

[21] Appl. No.: 745,514

[22] Filed: Nov. 26, 1976

[30] Foreign Application Priority Data

Dec. 26, 1975 Japan ..... 50-154725

[51] Int. Cl.[2] ..... G03G 15/00

[52] U.S. Cl. ..... 355/3 DD; 118/657; 222/DIG. 1; 427/18

[58] Field of Search ..... 355/3 DD; 118/656, 657, 118/658, 653; 427/18; 222/DIG. 1, 238, 254

[56] References Cited

U.S. PATENT DOCUMENTS

| | | | |
|---|---|---|---|
| 3,703,395 | 11/1972 | Drexler et al. | 427/18 |
| 3,965,862 | 6/1976 | Yang et al. | 118/657 X |
| 3,982,498 | 9/1976 | Wilcox | 427/18 X |
| 4,044,719 | 8/1977 | Ohmori | 355/3 DD |

*Primary Examiner*—R. L. Moses

*Attorney, Agent, or Firm*—J. J. Ralabate; C. A. Green; H. Fleischer

[57] ABSTRACT

An apparatus in which a developer mix of magnetic carrier granules having toner particles adhering triboelectrically thereto is brought into contact with an electrostatic latent image. The latent image attracts at least a portion of the toner particles thereto. A magnetic belt receives the denuded carrier granules and moves them into position to attract toner particles thereto from the chamber of a storage housing.

14 Claims, 2 Drawing Figures

DEVICE FOR REPLENISHING TONER PARTICLES

BACKGROUND OF THE INVENTION

This invention relates generally to an electrophotographic printing machine, and more particularly concerns a development apparatus employed therein.

In the process of electrophotographic printing a photoconductive member is charged to a substantially uniform level. Thereafter, a light image of an original document being reproduced is projected onto the charged portion of the photoconductive member to record an electrostatic latent image thereon. A developer mix comprising carrier granules and toner particles is brought into contact with the electrostatic latent image. The toner particles adhere triboelectrically to the carrier granules. The electrostatic latent image attracts the toner particles from the carrier granules forming a toner powder image on the photoconductive member. The toner powder image is transferred from the photoconductive member to a sheet of support material. Thereafter, the toner powder image is permanently affixed to the sheet of support material forming a copy of the original document being reproduced.

Generally, an electrophotographic printing machine utilizes a developer mix of carrier granules and toner particles. However, toner particles are continually being depleted from the developer mix as they are attracted from the carrier granules to the latent image recorded on the photoconductive member. For this reason, an electrophotographic printing machine generally utilizes a toner replenishing device for furnishing additional toner particles to the developer mix as it is consumed therein. A typical toner particle replenishing device may employ an open-ended box for storing toner particles therein. A plate having a grid structure moves across the open end of the box to dispense toner particles therefrom. However, a toner particles dispenser of this type may have numerous difficulties associated therewith. For example, frequently large quantities of toner particles are dropped into the developer mixture due to the pressure of the toner particles in the housing. In addition, the concentration of toner particles is not uniformly distributed within the developer mix. This may result in copy quality degradation.

Accordingly, it is the primary object of the present invention to replenish toner particles substantially uniformly to a developer mix.

SUMMARY OF THE INVENTION

Briefly stated, and in accordance with the present invention, there is provided an apparatus for developing an electrostatic latent image.

Pursuant to the features of the present invention, the development apparatus includes means for advancing a developer mix comprising magnetic carrier granules having toner particles adhering triboelectrically thereto into contact with the latent image. The latent image attracts at least a portion of the toner particles from the carrier granules. Magnetic means associated with the advancing means receives therefrom at least a portion of the carrier granules having the toner particles attracted therefrom. The magnetic means move the carrier granules into communication with an open end of a chamber in a housing storing a supply of toner particles. In this way, the carrier granules attract the toner particles and the resultant developer mix is received by the advancing means for subsequent reuse.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
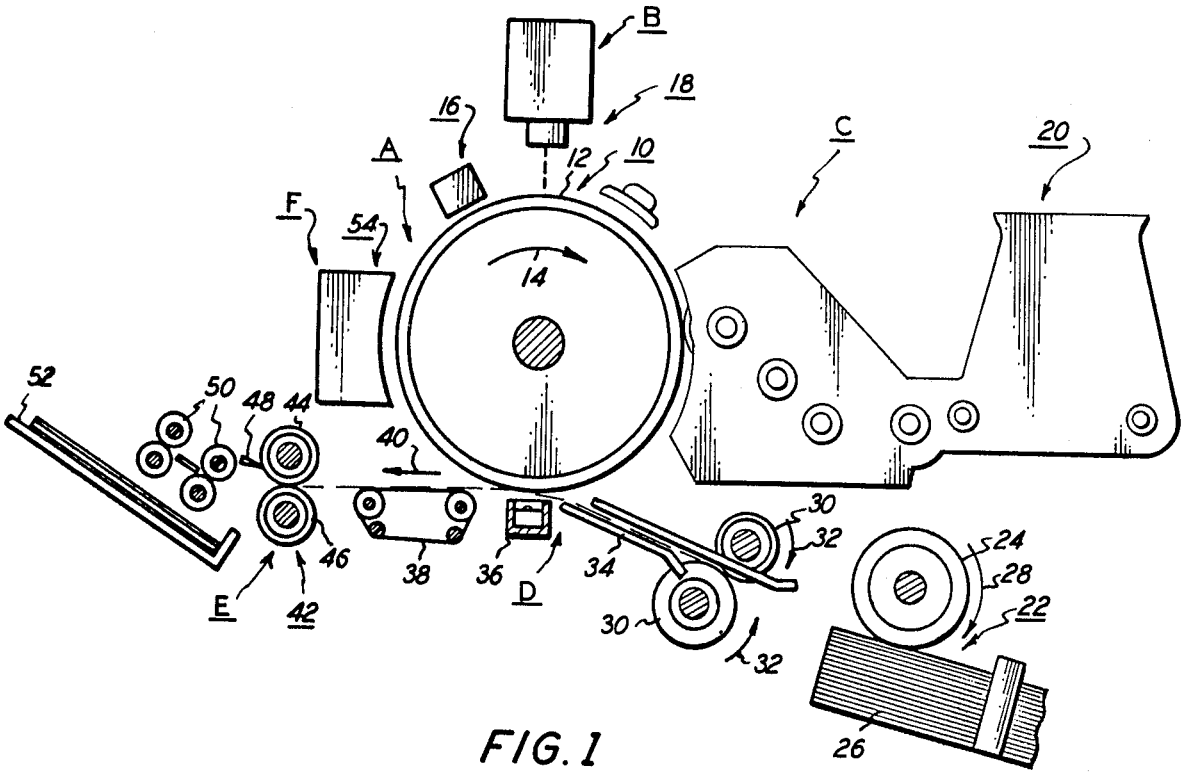
FIG. 1 is a schematic elevational view showing an electrophotographic printing machine incorporating the features of the present invention therein.

For a general understanding of an electrophotographic printing machine incorporating the features of the present invention therein, reference is had to FIG. 1 which depicts schematically the various components thereof. Hereinafter, like reference numerals will be employed throughout to designate identical elements. Although the development apparatus of the present invention is particularly well adapted for use in an electrophotographic printing machine, it should become evident from the following discussion that it is equally well suited for application in a wide variety of electrostatographic printing machines, and is not necessarily limited to the particular embodiment shown herein.

Inasmuch as the art of electrophotographic printing is well known, the various processing stations for producing a copy of an original document will be represented schematically in FIG. 1. Turning now to FIG. 1, each processing station will be described hereinafter.

The electrophotographic printing machine employs a drum 10 having a photoconductive surface 12 entrained about and secured to the exterior circumferential surface thereof. As drum 10 rotates in the direction of arrow 14, it passes through the various processing stations disposed about the periphery thereof. A suitable photoconductive material may be the type of selenium described in U.S. Pat. No. 2,970,906 issued to Bixby in 1961.

Initially, a portion of photoconductive surface 12 passes through charging station A. Charging station A includes a corona generating device, indicated generally by the reference numeral 16, positioned closely adjacent to photoconductive surface 12. In this way, corona generating device 16 charges photoconductive surface 12 to a relatively high substantially uniform potential. A suitable corona generating device is described in U.S. Pat. No. 2,836,725 issued to Vyverberg in 1958.

The charged portion of photoconductive surface 12 next, advances to exposure station B. At exposure station B, an exposure mechanism, indicated generally by the reference numeral 18, has a stationary housing for supporting an original document thereon. The housing comprises a transparent platen upon which the original document is positioned. Lamps illuminate the original document. Scanning of the original document is achieved by oscillating a mirror in a timed relationship with the movement of drum 10, or, in lieu thereof, by moving the lamp and lens system to form a flowing light image thereof. A light image of the original document is projected onto the charged portion of photoconductive surface 12 to selectively irradiate the surface and dissipate the charge thereon. This records an electrostatic latent corresponding to the informational areas contained within the original document.

Thereafter, the electrostatic latent image recorded on photoconductive surface 12 is advanced to development station C. At development station C, a developer unit 20 having a housing with a supply of developer mix contained therein renders the electrostatic latent image visible. The developer mix comprises magnetic carrier granules having toner particles adhering thereto. Preferably, these carrier granules are formed from a ferromagnetic material, while the toner particles are usually a heat-settable plastic. The toner particles are attracted triboelectrically to the carrier granules. Developer unit 20 is a magnetic brush development system with the developer mix being brought through a directional flux field to form a brush thereof. The brush of developer mix contacts the electrostatic latent image recorded on photoconductive surface 12. The latent image attracts the toner particles from the carrier granules to form a toner powder image on photoconductive surface 12. The detailed structure of development unit 20 will be discussed hereinafter with reference to FIG. 2.

With continued reference to FIG. 1, a sheet of support material is advanced by sheet feeding apparatus 22 to transfer station D. Sheet feeding apparatus 22 includes a feed roll 24 contacting the uppermost surface of the stack of sheets of support material 26. Feed roll 24 rotates in the direction of arrow 28 to advance the uppermost sheet from stack 26. Registration rollers 30, rotating in the direction of arrow 32, align and forward the advancing sheet of support material into chute 34. Chute 34 directs the advancing sheet of support material into contact with drum 10 in a timed sequence so that the toner powder image developed thereon contacts the advancing sheet of support material at transfer station D. Transfer station D includes a corona generating device 36. Corona generating device 36 sprays ions onto the side of the sheet of support material opposed from photoconductive surface 12. The toner powder image adhering to photoconductive surface 12 is then attracted therefrom to the surface of the sheet of support material in contact therewith. After transferring the toner powder image to the sheet of support material, endless belt conveyor 38 moves the sheet of support material in the direction of arrow 40 to fixing station E.

Fixing station E includes a fuser assembly, indicated generally by the reference numeral 42. Fuser assembly 42 heats the transferred powder image to permanently affix the powder image to the sheet of support material. Preferably, fuser assembly 42 includes a heated fuser roll, shown generally at 44, and a backup roll, indicated generally by the reference numeral 46. The sheet of support material, with the toner powder image thereon, is interposed between fuser roll 44 and backup roll 46. The toner powder image contacts fuser roll 44. A release material applicator applies sufficient release material to fuser roll 44 to prevent the toner powder image from adhering thereto. Stripper blade 48 separates the sheet from fuser roll 44. Thereafter, the sheet of support material is advanced by a series of rollers 50 to catch tray 52 for subsequent removal from the printing machine by the operator.

Invariably, residual toner particles remain adhering to photoconductive surface 12 after the transfer of the toner powder image to the sheet of support material. These residual toner particles are removed from photoconductive surface 12 at cleaning station F. Cleaning station F includes a cleaning mechanism, generally designated by the reference numeral 54, comprising a corona generating device and brush contacting photoconductive surface 12. Initially, the toner particles are brought under the influence of the cleaning corona generating device to neutralize the electrostatic charge remaining on photoconductive surface 12 and that of the residual toner particles. Thereafter, the neutralized toner particles are removed from photoconductive surface 12 by the rotatably mounted fibrous brush in contact therewith. After cleaning, a discharge lamp floods photoconductive surface 12 to return it to the initial level prior to the recharging thereof at station A for the next successive imaging cycle.

It is believed that the foregoing description is sufficient for the purposes of the foregoing application to illustrate the general operation of an electrophotographic printing machine which exemplifies one type of electrostatographic printing machine in which the present invention may be incorporated.

Figure 2:
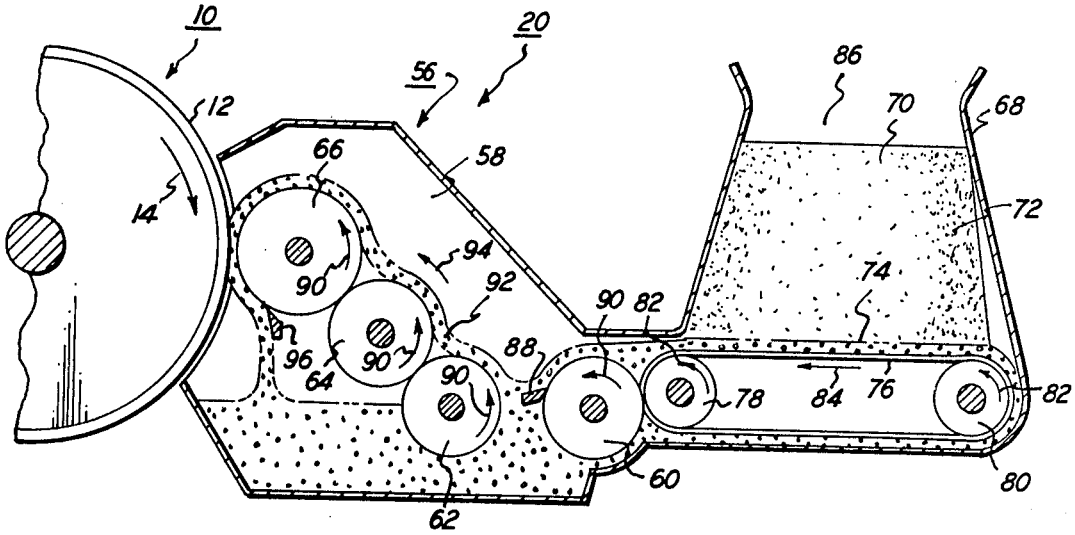
FIG. 2 is a schematic elevational view depicting a development system employed in the FIG. 1 printing machine.

Referring now to the specific subject matter of the present invention, FIG. 2 depicts the detailed structure of developer unit 20. Developer unit 20 includes a housing, indicated generally by the reference numeral 56, having an interior chamber 58 with a plurality of transfer magnetic rollers, 60, 62 and 64, and a developer magnetic roller 66 being disposed therein. Rollers 62, 64 and 66 are contiguous with one another while roller 60 is spaced from roller 62. Developer roller 66 is positioned adjacent to photoconductive surface 12 of drum 10. Housing 68 is integral with housing 56, and has a chamber 70 for storing a supply of toner particles 72 therein. Housing 68 comprises a first port or aperture 74 for dispensing toner particles onto a magnetic belt 76 entrained about a pair of opposed, spaced support rollers 78 and 80, respectively. Roller 80 is driven by a motor (not shown) in the direction of arrow 82 so as to advance belt 76 in the direction of arrow 84. Housing 68 includes a second port 86 for supplying additional toner particles to chamber 70 therein. Port 74 is larger than port 86. This is achieved by having the side walls of housing 68 taper substantially uniformly gradually in an outwardly direction from port 86 to port 74. Belt 76 is interposed between magnetic roller 60 and support roller 78. Magnetic roller 60 is in engagement with belt 76.

Blade 88 is provided close to the peripheral surface of roller 60 to scrape developer mix adhering to the peripheral surface thereof enabling the developer mix to be advanced toward magnetic roller 62. Magnetic roller 62 rotates in the direction of arrow 90 so as to advance the developer mix 92 in the direction of arrow 94. Developer mix 92 is advanced by roller 64, which also rotates in the direction of arrow 90, to developer roller 66. Developer roller 66 rotates in the direction of arrow 90 to advance developer mix 92 into contact with the electrostatic latent image recorded on photoconductive surface 12 of drum 10. The residual developer mix adhering to magnetic developer roller 66 and the carrier granules with the toner particles removed therefrom are stripped therefrom by blade 96. The residual developer mix and denuded carrier granules descend in a downwardly direction to the bottom of chamber 58 of housing 56.

Magnetic roller 60 advances the denuded carrier granules into contact with magnetic belt 76. As magnetic belt 76 rotates in the direction of arrow 84, the carrier granules move into communication with port 74 of housing 68. The carrier granules disposed on belt 76 then move into contact with toner particles 70. As the carrier granules sweep through port 76, toner particles are triboelectrically attracted thereto. In this way, a new supply of developer mix is formed which is subsequently advanced by magnetic roller 60 to magnetic rollers 62 and 64 which move the new supply of developer mix to developer roller 66. This new supply of developer mix is once again advanced to an electrostatic latent image recorded on photoconductive surface 12 of drum 10 to repeat the foregoing cycle. Additional toner particles may be added to housing 68 through port 86 as the supply thereof in chamber 72 is depleted.

By way of example, developer roller 66, transfer roller 60, 62 and 64 are all substantially identical. Each roller may be made from a non-magnetic tubular member, preferably formed from aluminum having an irregular or roughened exterior surface. The tubular member is journaled for rotation by suitable means such as ball bearing mounts. A shaft made preferably of steel is concentrically mounted within each tubular member and functions as a fixed mounting for magnets. Preferably, barium ferrite magnets in the form of angular rings are arranged about the interior shaft. Magnetic belt 76 has an irregular or roughened exterior surface to enhance the movement of the carrier granules. Preferably, support rollers 78 and 80 have flanges extending above the surfaces, thereby creating shoulders. Magnetic belt 76 rides on these flanges. Belt 76 may be formed by any means known to one skilled in the art. As shown, it comprises a sheet or web which may be formed from plastic, cloth, rubber or the like having attached to the underside thereof premanent magnets. The dimensions of support rollers 78 and 80 are chosen so that permanent magnets ride on the surface of the rollers between the flanges thereof. Thus, magnetic belt 76 is adapted to advance the carrier granules into close proximity with a supply of toner particles so as to attract the toner particles thereto. These carrier granules and toner particles are then advanced to a transfer roller for subsequent reuse in the development system.

In recapitulation, the denuded carrier granules in the development system chamber are attracted by a magnetic belt and pass closely adjacent to a supply of toner particles. The carriers attract the toner particles triboelectrically so as to form a developer mix. The developer mix is advanced to the electrostatic latent image where at least a portion of the toner particles are attracted thereto. The denuded carrier granules are attracted to a magnetic belt. The magnetic belt advances the carrier granules to the supply of toner particles where the carrier granules attract toner particles triboelectrically forming a new supply of developer mix. This developer mix is subsequently advanced into contact with the electrostatic latent image. Once again, the toner particles are attracted to the latent image and the denuded carrier granules repeat the foregoing. Hence, it is evident that the magnetic belt in combination with the transfer rollers and developer roller define an endless path for advancing developer mix to the electrostatic latent and returning at least carrier granules. These carrier granules receive new toner particles from the chamber of the housing storing a supply of toner particles therein. In this way, a new supply of developer mix is formed for subsequent advancement once again to the electrostatic latent image.

It is, therefore, evident that there has been provided, in accordance with the present invention, an apparatus for developing an electrostatic latent image in an electrophotographic printing machine. The apparatus comprises a toner replenishing device for uniformly adding additional toner particles to the denuded carrier granules. The apparatus of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing an electrostatic latent image, including:

means for advancing a developer mix comprising carrier granules having toner particles adhering triboelectrically thereto into contact with the latent image which attracts thereto at least a portion of the toner particles from the carrier granules;

a housing defining an open-ended chamber for storing therein a supply of toner particles; and magnetic means associated with said advancing means to receive therefrom at least a portion of the carrier granules having the toner particles attracted therefrom, said magnetic means moving the carrier granules into communication with the open end of the chamber of said housing to attract triboelectrically therefrom toner particles, said advancing means receiving the carrier granules having the toner particles adhering thereto triboelectrically from said magnetic means.

2. An apparatus as recited in claim 1, wherein said advancing means and said magnetic means define an endless path for advancing developer mix to the latent image and returning at least carrier granules which receive toner particles from the chamber of said housing to form developer mix for advancement to the latent image.

3. An apparatus as recited in claim 2, wherein said magnetic means include:

a pair of opposed, spaced support rollers; and a magnetic belt entrained about said pair of support rollers.

4. An apparatus as recited in claim 3, wherein said advancing means includes:

a magnetic developer roll disposed closely adjacent to the latent image to move the developer mix into contact therewith; and a magnetic transfer roller associated with said developer roller and positioned to have said magnetic belt interposed between said transfer roller and one of said support rollers with said transfer roller engaging said magnetic belt.

5. An apparatus as recited in claim 4, wherein the open end of the chamber of said housing includes a first port closely adjacent to said magnetic belt for dispensing toner particles to the carrier granules disposed thereon.

6. An apparatus as recited in claim 5, wherein said housing includes a second port in communication with the chamber thereof to permit additional toner particles to be added thereto, said second port being substantially opposed from said first port with said first port having an aperture greater than the aperture of said second port.

7. An apparatus as recited in claim 6, wherein the chamber of said housing tapers outwardly substantially uniformly from the second port to the first port.

8. An electrophotographic printing machine, including:

a photoconductive member;

means for recording an electrostatic latent image on said photoconductive member;

means for advancing a developer mix comprising carrier granules having toner particles adhering triboelectrically thereto into contact with the latent image which attracts thereto at least a portion of the toner particles from the carrier granules;

a housing defining an open-ended chamber for storing therein a supply of toner particles; and magnetic means associated with said advancing means to receive therefrom at least a portion of the carrier granules having the toner particles attracted therefrom, said magnetic means moving the carrier granules into communication with the open end of the chamber of said housing to attract triboelectrically therefrom toner particles, said advancing means receiving the carrier granules having the toner particles adhering triboelectrically thereto from said magnetic means.

9. A printing machine as recited in claim 8, wherein said advancing means and said magnetic means define an endless path for advancing developer mix to the latent image and returning at least carrier granules which receive toner particles from the chamber of said housing to form developer mix for advancement to the latent image.

10. A printing machine as recited in claim 9, wherein said magnetic means includes:

a pair of opposed, spaced support rollers; and a magnetic belt entrained about said pair of support rollers.

11. A printing machine as recited in claim 10, wherein said advancing means includes:

a magnetic developer roller disposed closely adjacent to the latent image to move the developer mix into contact therewith; and a magnetic transfer roller associated with said developer roller and positioned to have said magnetic belt interposed between said transfer roller and one of said support rollers with said transfer roller engaging said magnetic belt.

12. A printing machine as recited in claim 11, wherein the open end of the chamber of said housing includes a first port located closely adjacent to said magnetic belt for dispensing toner particles to the carrier granules.

13. A printing machine as recited in claim 12, wherein said housing includes a second port in communication with the chamber thereof to permit additional toner particles to be added thereto, said second port being substantially opposed from said first port with said first port having an aperture greater than the aperture of said second port.

14. A printing machine as recited in claim 13, wherein the chamber of said housing tapers outwardly substantially uniformly from the second port to the first port.

* * * * *